US009901130B2

(12) United States Patent
Morris

(10) Patent No.: US 9,901,130 B2
(45) Date of Patent: Feb. 27, 2018

(54) FITNESS SUPPORT AND STORAGE ACCESSORY

(71) Applicant: Ian Morris, Queens, NY (US)

(72) Inventor: Ian Morris, Queens, NY (US)

( * ) Notice: Subject to any disclaimer, the term of this patent is extended or adjusted under 35 U.S.C. 154(b) by 273 days.

(21) Appl. No.: 14/812,889

(22) Filed: Jul. 29, 2015

(65) Prior Publication Data

US 2016/0029719 A1 Feb. 4, 2016

Related U.S. Application Data

(60) Provisional application No. 62/030,347, filed on Jul. 29, 2014.

(51) Int. Cl.

| | |
|---|---|
| ***A41D 19/00*** | (2006.01) |
| ***A63B 71/14*** | (2006.01) |
| ***A41D 19/015*** | (2006.01) |

(52) U.S. Cl.

CPC ..... *A41D 19/002* (2013.01); *A41D 19/0013* (2013.01); *A41D 19/0037* (2013.01); *A41D 19/0044* (2013.01); *A41D 19/0048* (2013.01); *A41D 19/01517* (2013.01); *A63B 71/141* (2013.01); *A63B 71/145* (2013.01); *A63B 2209/08* (2013.01); *A63B 2209/10* (2013.01); *A63B 2210/50* (2013.01); *A63B 2225/685* (2013.01); *A63B 2225/687* (2013.01); *A63B 2244/09* (2013.01); *A63B 2244/102* (2013.01)

(58) Field of Classification Search

CPC ..... A41D 19/002; A41D 19/0013; A41D 19/0037; A41D 19/0044; A41D 19/0048; A41D 19/01517; A63B 71/141; A63B 71/145; A63B 2209/10; A63B 2210/50; A63B 2225/685; A63B 2225/687; A63B 2244/09; A63B 2244/109

See application file for complete search history.

(56) References Cited

U.S. PATENT DOCUMENTS

| | | | | |
|---|---|---|---|---|
| 4,761,835 A * | 8/1988 | Chen | A41D 19/0027 | 2/160 |
| 4,805,242 A * | 2/1989 | Bolton | A41D 19/0024 | 2/160 |
| 5,743,806 A * | 4/1998 | Brennan | A63B 69/0059 | 473/214 |
| 2003/0154536 A1* | 8/2003 | Anderson | A41D 3/02 | 2/108 |

(Continued)

*Primary Examiner* — Shaun R Hurley
*Assistant Examiner* — Andrew W Sutton

(57) ABSTRACT

A fitness support and storage accessory has a glove and a sleeve for supporting a user's hand and forearm, respectively, while working out and a plurality of storage compartments for securing everyday items. The glove has a sleeve connector, while the sleeve has a glove connector; the sleeve connector and the glove connector allowing the glove to be removably attached to the sleeve. The plurality of storage compartments is integrated into both the glove and the sleeve, having a card holder, a phone holder, and a pouch. The card holder is integrated into the glove, while the phone holder and the pouch are integrated into the sleeve. Each of the plurality of storage compartments has a compartment closure to secure the items positioned within. The glove has a hand portion that can be configured as a fingerless glove for weightlifting or as a boxing glove.

16 Claims, 6 Drawing Sheets

(56) References Cited

U.S. PATENT DOCUMENTS

| | | | | |
|---|---|---|---|---|
| 2011/0072552 | A1* | 3/2011 | Johnson | A41D 19/002 2/160 |
| 2012/0066810 | A1* | 3/2012 | Marcus | A41D 19/01529 2/16 |
| 2013/0007943 | A1* | 1/2013 | Thorsen | A41D 19/0089 2/160 |
| 2014/0157475 | A1* | 6/2014 | Smith | A41D 19/0062 2/16 |
| 2016/0029719 | A1* | 2/2016 | Morris | A41D 19/01517 2/160 |
| 2016/0037839 | A1* | 2/2016 | Vandenbosch | A41D 19/01576 2/457 |
| 2016/0249694 | A1* | 9/2016 | Sullivan | A41D 19/0048 |

* cited by examiner

FITNESS SUPPORT AND STORAGE ACCESSORY

The current application claims a priority to the U.S. Provisional Patent application Ser. No. 62/030,347 filed on Jul. 29, 2014.

FIELD OF THE INVENTION

The present invention relates generally to fitness gloves. More specifically, the present invention is a fitness support and storage accessory having a glove and sleeve to support a user's hand and forearm, and a plurality of storage compartments for retaining items such as a phone, identification card, and keys.

BACKGROUND OF THE INVENTION

Fitness gloves are a common sight in gyms and weight rooms. The reasons for the fitness gloves are to protect an individual's hand from the weights and to prevent calluses on the palms of the hands. Though this problem has been solved, there is still another problem that individuals face at the gym. People have yet to find a convenient method to store items such as phones, cards, keys, and other small items all together. There are arm bands that are successful in containing smart phones or mp3 player and perhaps other thin items, however, they do not provide storage for other items. Other than the known arm bands, people still must carry multiple items throughout the gym, increasing the chances of losing items. Additionally, this leads to having pockets full of items, or a having a handful of items to carry around while trying to work out.

Therefore it is the object of the present invention to provide a fitness support and storage accessory that is designed to support to a user's hand and forearm while working out in addition to providing a number of storage options for securing everyday items. The present invention has a glove with a hand portion being configured as either a fingerless glove or a boxing glove. The glove is attached to a sleeve that is positioned around the user's forearm. A plurality of storage compartments is integrated into the glove and the sleeve, providing the user with multiple options for storing various items, such as keys, money, an identification card, a credit card, or a phone. The present invention provides a convenient and efficient means for storing items, giving individuals at the gym peace of mind while working out, knowing that all of their personal belongings are safely secured on his or her arm.

DETAIL DESCRIPTIONS OF THE INVENTION

All illustrations of the drawings are for the purpose of describing selected versions of the present invention and are not intended to limit the scope of the present invention.

The present invention is a fitness support and storage accessory that is designed to provide support to a user's hand and forearm while working out, in addition to providing a number of storage options for securing everyday items. The fitness support and storage accessory comprises a glove 1, a sleeve 2, and a plurality of storage compartments 3. The glove 1 and the sleeve 2 provide support to the user's hand and forearm, respectively, in addition to support around the user's wrist. The plurality of storage compartments 3 is integrated into the glove 1 and the sleeve 2, as shown in FIG. 1, and provides the user with a number of options for storing and securing items such as a phone, identification card, credit card, or keys.

Figure 1:
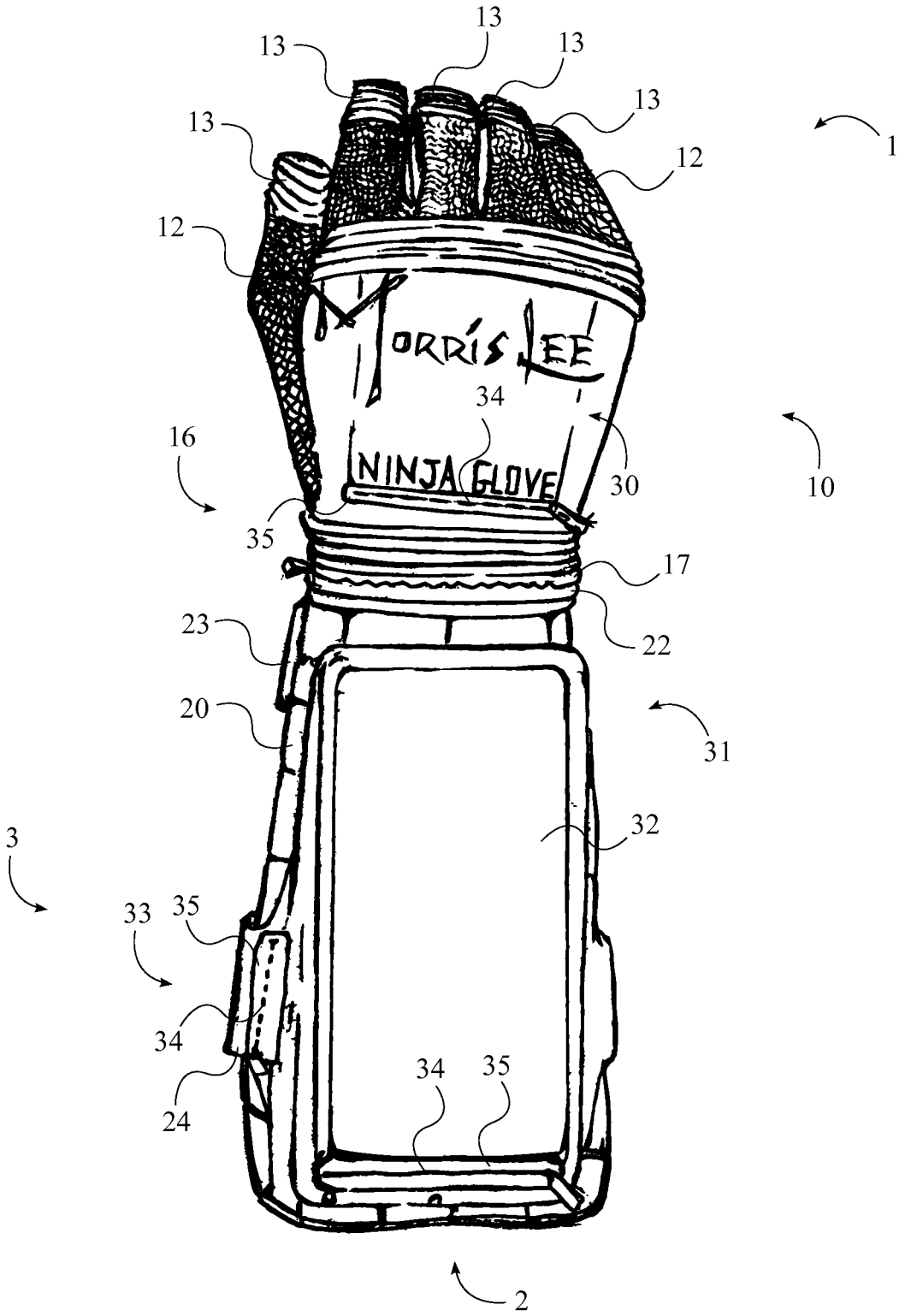
FIG. 1 is a top plan view of the present invention.
Figure 4:
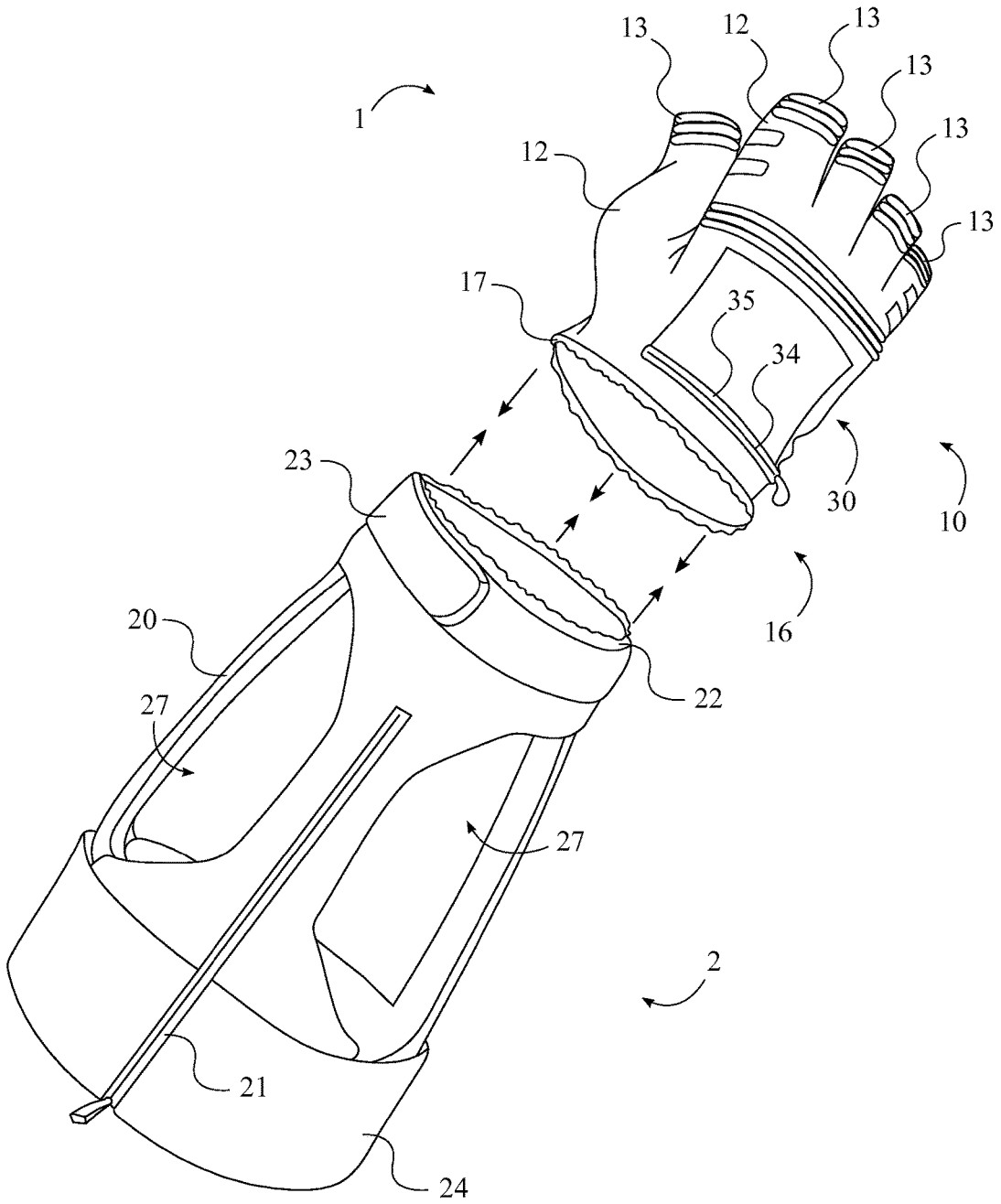
FIG. 4 is a perspective view of the present invention, depicting the detachable nature of the glove and the sleeve.

In reference to FIG. 1 and FIG. 4, the glove 1 comprises a hand portion 10, a wrist portion 16, and a sleeve connector 17; the hand portion 10 covering the user's hand and the wrist portion 16 extending around the user's wrist. The wrist portion 16 is adjacently connected to the hand portion 10, while the sleeve connector 17 is perimetrically connected to the wrist portion 16 opposite the hand portion 10. The sleeve connector 17 allows the glove 1 to be removably attached to the sleeve 2. This is beneficial, as some workout routines do not require gloves, thus allowing the user to still benefit from the support of the sleeve 2 and the storage options integrated into the sleeve 2. The sleeve connector 17 also allows the user to easily attach or detach the glove 1 mid workout.

Figure 3:
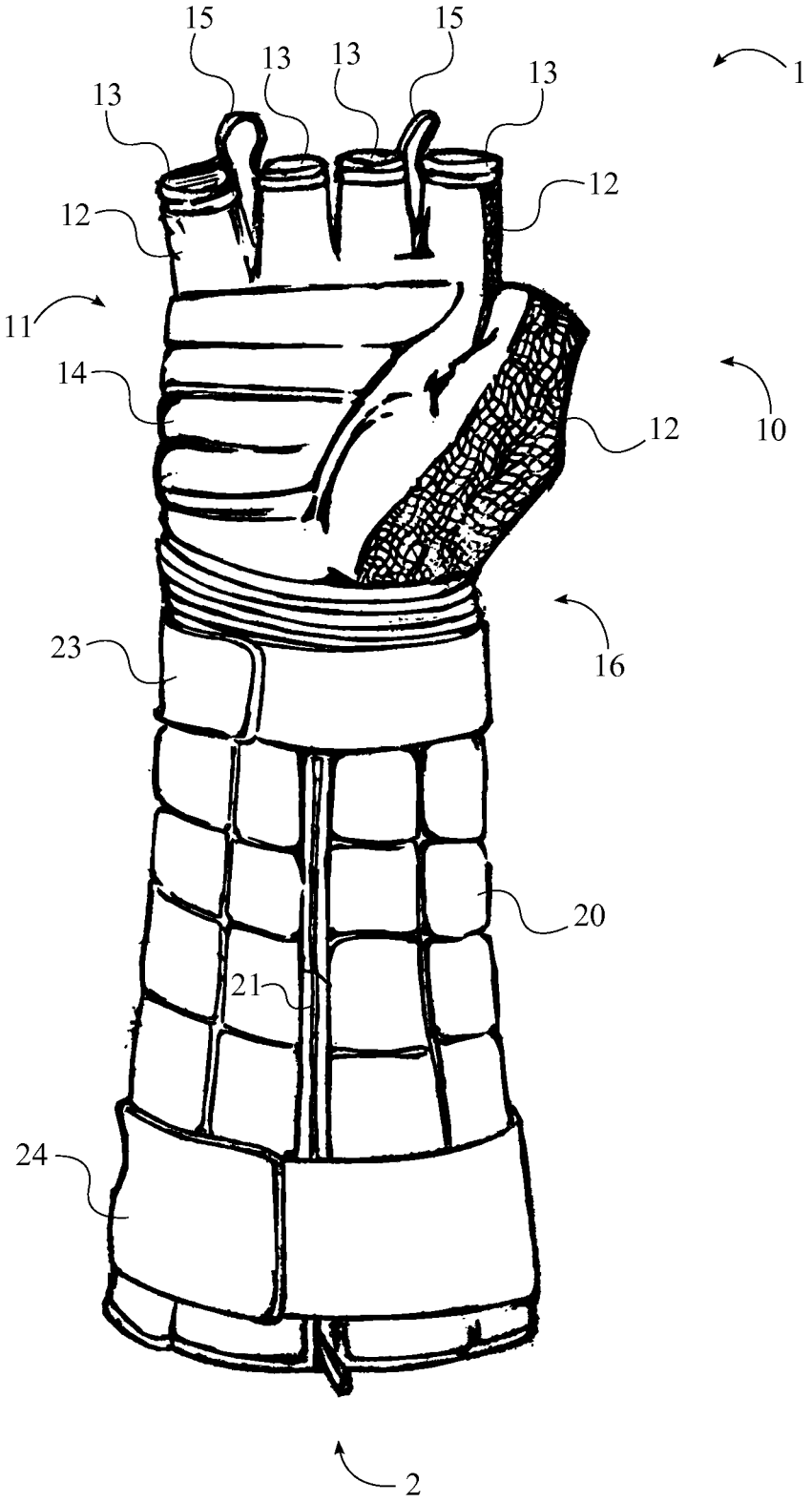
FIG. 3 is a bottom plan view of the present invention, wherein the hook fastener of the proximal strap and the distal strap is engaging the loop fastener of the proximal strap and the distal strap, respectively.

In reference to FIG. 3, in the preferred embodiment of the present invention, the hand portion 10 comprises a palm section 11, a plurality of open finger sections 12, a plurality of knuckle pads 13, a palm pad 14, and an at least one pull tab 15. The palm section 11 is positioned in between the wrist portion 16 and the plurality of open finger sections 12, wherein the palm section 11 covers the user's palm. Meanwhile, the plurality of open finger sections 12 cover a portion of the user's fingers. In the preferred embodiment, each of the plurality of open finger sections 12 terminates at a half finger length around the first knuckle of each finger, however, it is possible for each of the plurality of open finger sections 12 to cover more or less of the user's fingers in other embodiments of the present invention.

Both the plurality of knuckle pads 13 and the palm pad 14 provide the user with additional grip by providing a material surface with a higher coefficient of friction. Additionally, the plurality of knuckle pads 13 and the palm pad 14 enhance the comfort of the user. In reference to FIG. 3, the plurality of knuckle pads 13 is adjacently connected to the plurality of open finger sections 12, wherein the plurality of knuckle pads 13 is positioned along the plurality of open finger sections 12 opposite the palm section 11; the plurality of knuckle pads 13 being positioned around the first knuckle of each finger when the user's hand is inserted into the glove 1. Preferably, each of the plurality of knuckle pads 13 is a stretchable rubber, such that the plurality of knuckle pads 13 conform and constrict around the user's fingers for a tight fit, while providing increased friction with contact surfaces.

In further reference to FIG. 3, the palm pad 14 is adjacently connected to the palm section 11 providing enhanced comfort and grip about the user's palm when the user's hand is inserted into the glove 1. Preferably, the palm pad 14 is a gel type pad, such that the palm pad 14 is able to sufficiently reform for gripping various shaped objects. However, it is also possible for other materials to be used such as a rubber type pad, or for a combination of materials to be used, such as a rubber coated gel pack. Furthermore, the palm pad 14 is vented in order to allow airflow through the palm section 11, ensuring that the user's hand is well ventilated to prevent overheating.

In yet further reference to FIG. 3, the at least one pull tab 15 provides a means for easily removing the glove 1 from the user's hand. The at least one pull tab 15 is adjacently connected to the plurality of open finger sections 12; more specifically, each of the at least one pull tab 15 is positioned in between a pair of finger sections from the plurality of open finger sections 12. Each of the at least one pull tab 15 is a length of material terminally connected at each end to the plurality of open finger sections 12, wherein the user can grasp or hook each of the at least one pull tab 15 with the opposite hand. In the preferred embodiment, the at least one pull tab 15 is specifically two pull tabs; one pull tab being positioned in between the index finger and middle finger, and another pull tab being positioned in between the ring finger and the pinky finger.

The hand portion 10 and the wrist portion 16 are preferably constructed from a stretchable material such that the hand portion 10 is form fitting and is sufficiently tight around the user's hand to prevent slipping. Furthermore, the hand portion 10 and the wrist portion 16 are preferably constructed from a breathable material, allowing for maximum airflow through the material. This enhances the comfort of the user while utilizing the present invention and helps prevent the user's extremities from becoming overheated.

Figure 5:
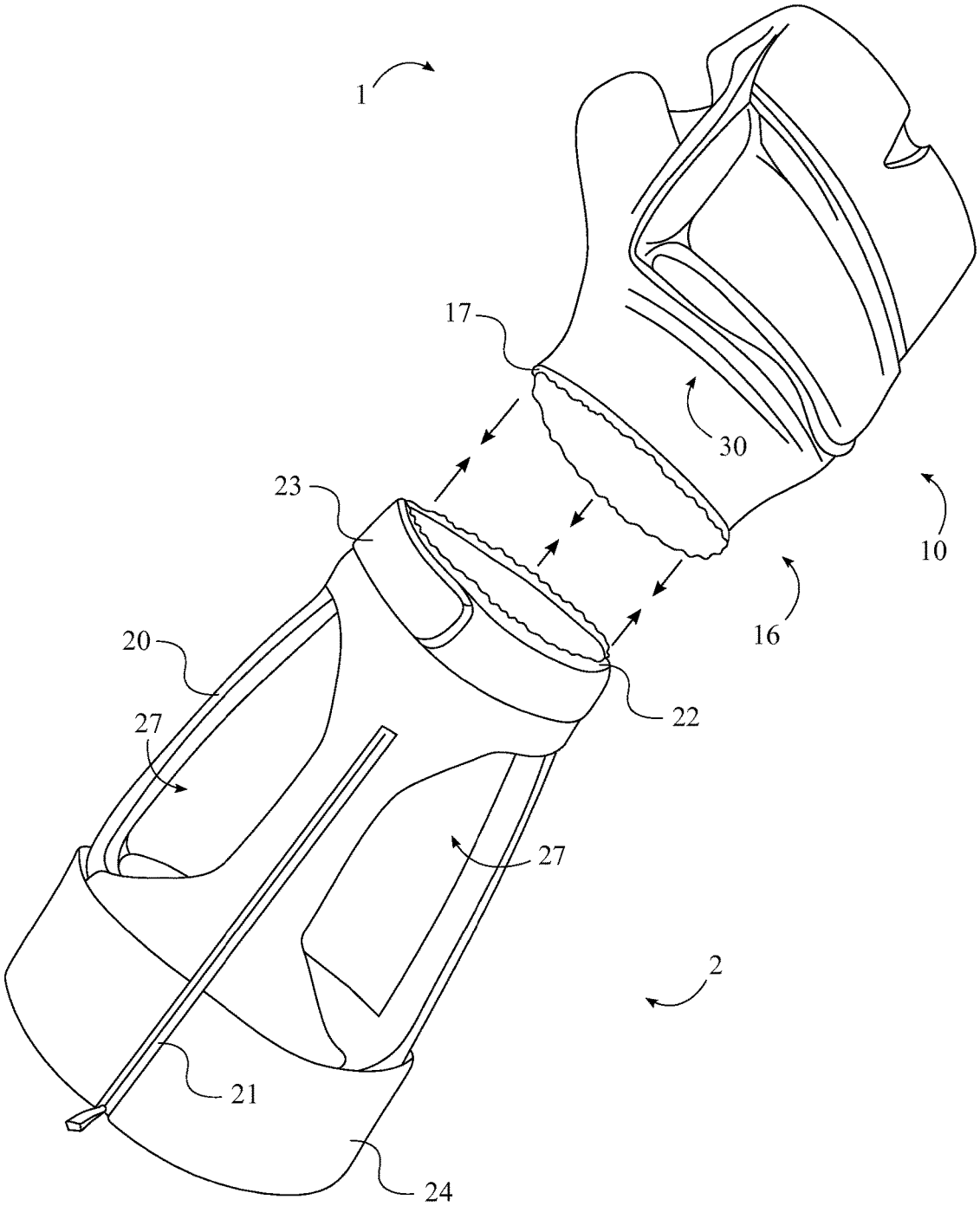
FIG. 5 is a perspective view of the present invention, wherein the hand portion of the glove is a boxing glove.

In an alternative embodiment of the present invention, the hand portion 10 is a boxing glove, as depicted in FIG. 5. This provides the user with the functionality of a boxing glove, along with the storage ability of the present invention. Furthermore, the detachable nature of the glove 1 from the sleeve 2 allows the user to interchange the glove 1 depending on the workout routine. For example, a boxer may switch between weightlifting routines and sparring practice. If the boxer has a glove 1 configured as a boxing glove and a glove 1 having the plurality of open finger sections 12, then the boxer can interchange the glove 1 that is currently being used with the sleeve 2 depending on the specific workout routine.

Figure 2:
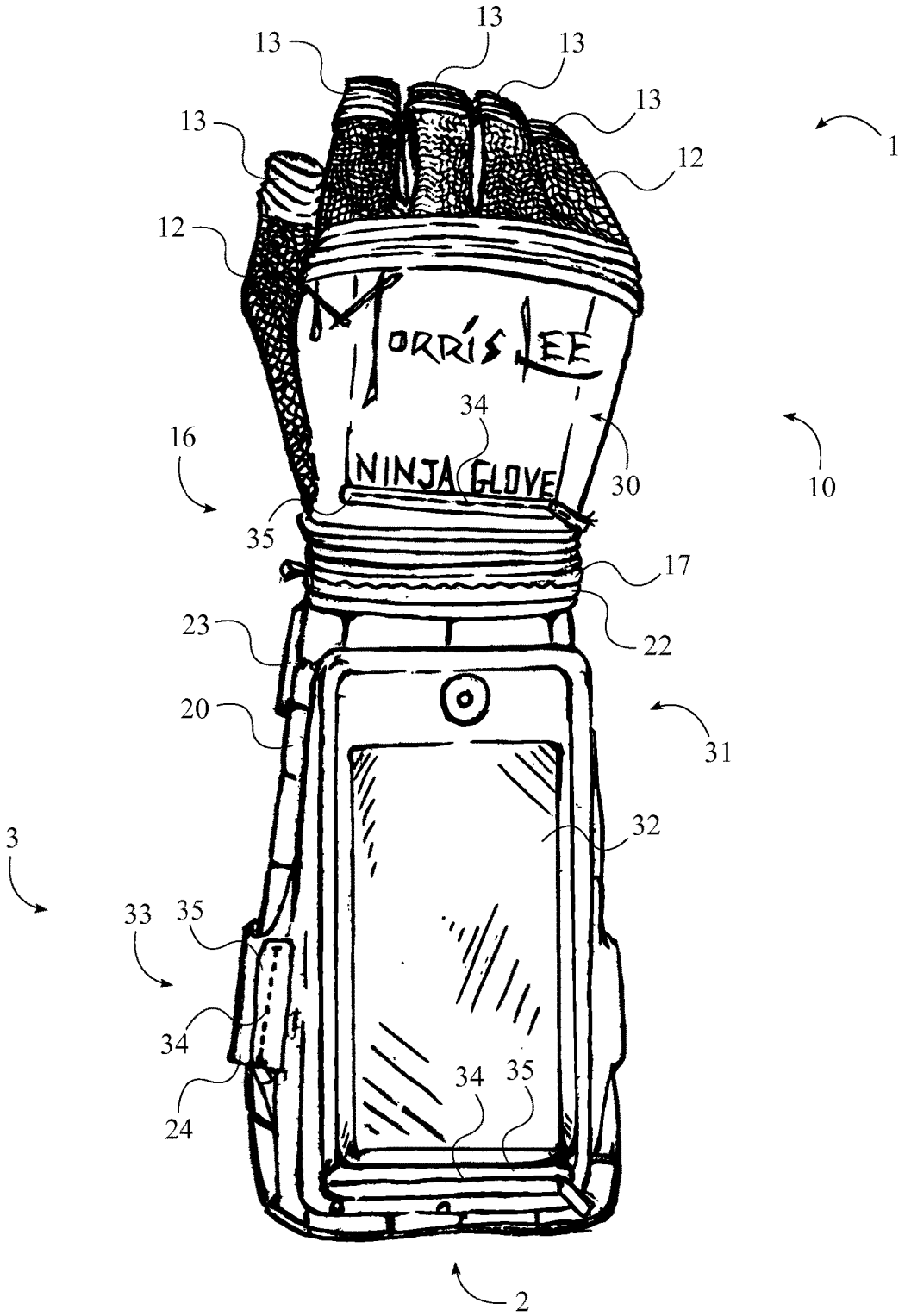
FIG. 2 is a top plan view of the present invention, wherein a smartphone is positioned within the phone holder.

In reference to FIG. 2-3, the sleeve 2 comprises a forearm cuff 20, a glove connector 22, a proximal strap 23, and a distal strap 24. The forearm cuff 20 is a tapered sleeve 2 designed to fit around and conform to the user's forearm. Preferably, the forearm cuff 20 is constructed from a breathable material to allow for proper ventilation and a stretchable material such that the forearm cuff 20 constricts and conforms to the user's forearm. The forearm cuff 20 comprises an accessibility zipper 21 that is positioned along the cuff, preferably beginning at the larger end of the forearm cuff 20. The accessibility zipper 21 may travers along the entirety of the forearm cuff 20 or only a portion of the forearm cuff 20. The accessibility zipper 21 allows the forearm cuff 20 to be spread open, allowing the sleeve 2 to be attached to or removed from the user's forearm with less effort.

In reference to FIG. 2 and FIG. 4, the glove connector 22 is perimetrically connected to the forearm cuff 20 and terminally positioned on the forearm cuff 20 about the smaller end of the forearm cuff 20, located adjacent to the user's wrist when the user's arm is inserted into the sleeve 2. The glove connector 22 is adjacently attached to the sleeve connector 17; the glove 1 being removably attached to the sleeve 2 through the sleeve connector 17 and the glove connector 22. In one embodiment of the present invention, the sleeve connector 17 and the glove connector 22 are a set of interlocking teeth (i.e. a zipper). The sleeve connector 17 being a first set of teeth and the glove connector 22 being a second set of teeth.

If the sleeve connector 17 and the glove connector 22 are a set of interlocking teeth, then the present invention further comprises a slider, a pin box, and an insertion pin. The slider, the pin box, and the insertion pin can be configured in two ways. In one configuration the slider is slidably connected to the first set of teeth, wherein the slider also engages the second set of teeth. Meanwhile, the pin box is terminally connected to the first set of teeth, while the insertion pin is terminally connected to the second set of teeth, wherein the insertion pin is positioned into the pin box. In the second configuration the slider is slidably connected to the second set of teeth, wherein the slider also engages the first set of teeth. Meanwhile, the pin box is terminally connected to the second set of teeth, while the insertion pin is terminally connected to the first set of teeth, wherein the insertion pin is positioned into the pin box.

In another embodiment of the present invention, the sleeve connector 17 and the glove connector 22 are magnets with opposing magnetic fields. The nature of the opposing magnetic fields allows the sleeve connector 17 to be magnetically attached to the glove connector 22. The sleeve connector 17 and the glove connector 22 can each be a single magnet or a plurality of magnets positioned around the wrist portion 16 and the forearm cuff 20 respectively.

In yet another embodiment of the present invention, the sleeve connector 17 and the glove connector 22 are opposing hook and loop fasteners. At least one hook fastener and at least one loop fastener allow the glove 1 and the sleeve 2 to be removably attached to each other. If the sleeve connector 17 is the at least one hook fastener, then the glove connector 22 is the at least one loop fastener. Alternatively, if the glove connector 22 is the at least one hook fastener, then the sleeve connector 17 is the at least one loop fastener.

In some embodiments of the present invention, the glove 1 may be permanently connected to the sleeve 2 about a single edge. In this way, the glove 1 can be folded back on the sleeve 2 along the single edge when not in use; the sleeve connector 17 and the glove connector 22 fully attaching the glove 1 to the sleeve 2 when needed. In order to keep the glove 1 folded back on the sleeve 2, the glove 1 may further comprise a first attachment point, while the sleeve 2 comprises a second attachment point. The first attachment point is positioned along the glove 1 opposite the sleeve connector 17 and preferably on one of the plurality of open finger sections 12. The second attachment point can be positioned on the proximal strap 23 or on the forearm cuff 20, adjacent to the proximal strap 23. The first attachment point engages the second attachment point in order to temporarily connect the glove 1 to the sleeve 2 in the folded back position; any type of locking/connecting mechanism may be utilized.

Figure 6:
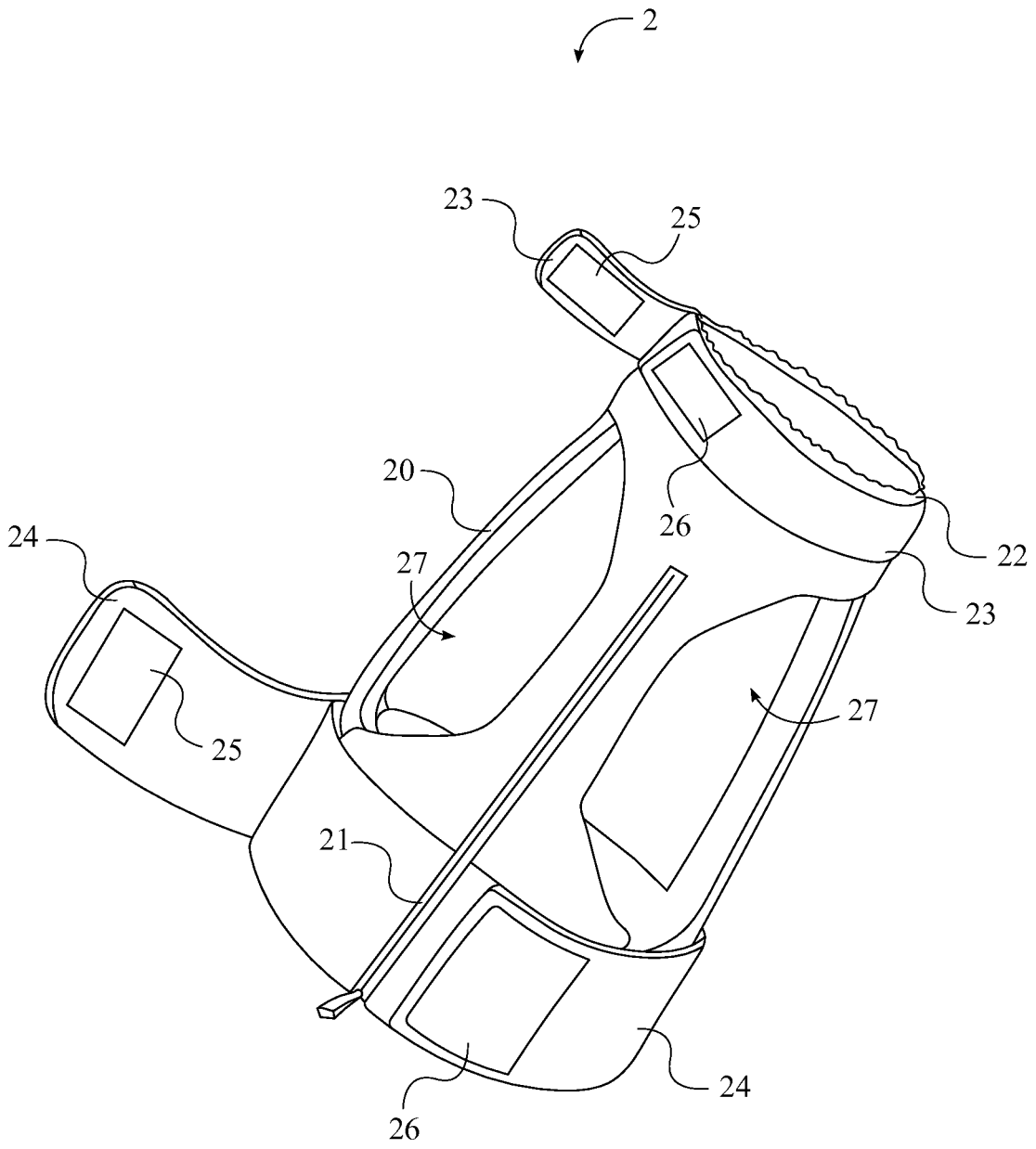
FIG. 6 is a perspective view of the sleeve, showing the hook fastener and the loop fastener of the proximal strap and the distal strap.

The proximal strap 23 and the distal strap 24 are both adjacently connected to the forearm sleeve 2 and allow the user to tighten the sleeve 2 around the user's forearm to prevent slippage. The proximal strap 23 is positioned adjacent to the glove connector 22, while the distal strap 24 is positioned along the forearm cuff 20 opposite the proximal strap 23. In the preferred embodiment of the present invention, both the proximal strap 23 and the distal strap 24 are stretchable and each comprises a hook fastener 25 and a loop fastener 26, as depicted in FIG. 6; the hook fastener 25 of the proximal strap 23 engaging the loop fastener 26 of the proximal strap 23 and the hook fastener 25 of the distal strap 24 engaging the loop fastener 26 of the distal strap 24. In this way, the proximal strap 23 or the distal strap 24 can be stretched and then fastened in order to achieve the desired tightness around the user's forearm.

In reference to FIG. 4, the sleeve 2 may further comprise an at least one breathable opening 27. The at least one breathable opening 27 traverses through the forearm cuff 20, resulting in an absence of material for a section of the forearm cuff 20. The at least one breathable opening 27 maximizes ventilation of the user's forearm while leaving enough material of the forearm sleeve 2 to adequately support the plurality of storage compartments 3 and the user's forearm.

In reference to FIG. 1-2, the plurality of storage compartments 3 is integrated into both the glove 1 and the sleeve 2 and allows the user to store and secure a variety of common items while working out. The plurality of storage compartments 3 comprises a card holder 30, a phone holder 31, and a pouch 33, wherein each of the plurality of storage compartments 3 comprises compartment closure 34 and a lateral edge 35. The compartment closure 34 is positioned along the lateral edge 35 for each of the plurality of storage compartments 3, allowing the individual compartment to be sealed shut and thus preventing the items inside from falling out. In the preferred embodiment of the present invention, the compartment closure 34 is a zipper that traverses along the lateral edge 35 and thus is able to effectively close the individual compartment completely and securely. In other embodiments of the present invention, the compartment closure 34 may be a hook and loop fastener, magnet, or other type of closure.

In reference to FIG. 1, the card holder 30 is integrated into the hand portion 10 of the glove 1, being positioned adjacent to the wrist portion 16. Furthermore, the card holder 30 is positioned on the top half of the glove 1, opposite the palm section 11. The lateral edge 35 of the card holder 30 is positioned adjacent to the wrist portion 16 and is parallel to the wrist portion 16. The card holder 30 allows the user to conveniently store an identification card, credit card, or other type of card securely. The location of the card holder 30 on the top of the glove 1 does not interfere with the user while working out and allows for convenient and easy access to the cards stored within.

In reference to FIG. 1-2, the phone holder 31 is positioned along the sleeve 2 and is adjacently connected to the forearm cuff 20. The phone holder 31 is designed to store and secure a smartphone and may be designed to fit a specific type of smartphone or a variety of smartphone types. In the preferred embodiment of the present, the lateral edge 35 of the phone holder 31 is positioned adjacent to the distal strap 24, however, in other embodiments of the present invention, the lateral edge 35 of the phone holder 31 may be positioned adjacent to the proximal strap 23 or in between the proximal strap 23 and the distal strap 24. The phone holder 31 comprises a transparent cover 32 that is positioned about the phone holder 31 opposite the forearm cuff 20, such that the transparent cover 32 is positioned adjacent to the screen of the smartphone when the smartphone is positioned within the phone holder 31. The transparent cover 32 allows the user to view the touchscreen of the smartphone and also interact with the touchscreen through the transparent cover 32.

In reference to FIG. 1, similar to the phone holder 31, the pouch 33 is integrated into the sleeve 2. The pouch 33 is positioned adjacent to the phone holder 31, wherein the phone holder 31 is positioned along the top of the user's forearm and the pouch 33 is positioned on one of the sides of the user's forearm when the sleeve 2 is worn. The pouch 33 is a small compartment that allows the user to store and secure small items such as keys, money, etc. In some embodiments of the present invention, the pouch 33 may be integrated into the distal strap 24. Ideally, the lateral edge 35 of the pouch 33 is positioned adjacent to the phone holder 31, however, the lateral edge 35 of the pouch 33 may be positioned otherwise.

To use the present invention, the user's hand is inserted into the larger opening of the sleeve 2, through the entirety of the sleeve 2, and into the glove 1, wherein the user's fingers extend through the plurality of open finger sections 12. With the user's forearm positioned within the sleeve 2, the accessibility zipper 21 is closed and the proximal strap 23 and the distal strap 24 are tightened and secured. The proximal strap 23 and the distal strap 24 may be pulled until the user feels comfortable. Alternatively, the sleeve 2 and the glove 1 can first be attached to the user individually and then the glove 1 can be attached to the sleeve 2.

Once the present invention is secured on the user's forearm, the user may choose to insert items into the plurality of storage compartments 3. The user may put a card into the card holder 30 by opening the compartment closure 34 of the card holder 30, and then secure the card by closing the compartment closure 34 of the card holder 30. Similarly, the user may choose to insert a smartphone into the phone holder 31 by opening the compartment closure 34 of the phone holder 31, and then secure the smartphone by closing the compartment closure 34 of the phone holder 31. The user can then interact with the touchscreen of the smartphone through the transparent cover 32. Any keys, money, or other small items can be stored in the pouch 33 by opening the compartment closure 34 of the pouch 33, inserting the items, and then securing the compartment closure 34 of the pouch 33 closed.

All the storage units may be engaged at the same time and may be filled with contents at the same time. The user may then move freely throughout his or her workout without worrying about personal belongings falling out of his or her pockets, or losing items in general, while having easy access to his or her phone. The user's hands are free to move and lift heavy weights, with each of the plurality of storage compartments 3 being positioned as to not interfere with the user while working out.

In alternative embodiments of the present invention, the plurality of storage compartments 3 may further comprise a variety of other storage compartments that do not disturb the user's workout routine. Such other storage compartments may come in a variety of shapes and sizes, and may or may not be designed to secure specific items.

Although the invention has been explained in relation to its preferred embodiment, it is to be understood that many other possible modifications and variations can be made without departing from the spirit and scope of the invention as hereinafter claimed.

What is claimed is:

1. A fitness support and storage accessory comprising:

a glove;

a sleeve;

the glove comprising a hand portion, a wrist portion and a sleeve connector;

the sleeve comprising a forearm cuff, a glove connector, a proximal strap and a distal strap;

the wrist portion being adjacently connected to the hand portion;

the sleeve connector being perimetrically connected to the wrist portion opposite the hand portion;

the glove connector being perimetrically connected to the forearm cuff;

the glove connector being terminally positioned on the forearm cuff;

the proximal strap and the distal strap being adjacently connected to the forearm cuff;

the proximal strap being positioned adjacent to the glove connector;

the distal strap being positioned along the forearm cuff opposite the proximal strap;

the sleeve connector being adjacently attached to the glove connector;

a plurality of storage compartments being integrated into the glove and the sleeve;

the plurality of storage compartments comprising a phone holder and a pouch;

the phone holder being positioned along the sleeve;

the phone holder being adjacently connected to the forearm cuff;

the phone holder comprising a transparent cover;

the transparent cover being positioned about the phone holder opposite the forearm cuff;

the pouch being positioned adjacent to the phone holder;

the pouch being integrated into the sleeve; and the pouch being integrated into the distal strap.

2. The fitness support and storage accessory as claimed in claim 1 comprising:

the plurality of storage compartments comprising a card holder;

the card holder being integrated into the hand portion; and the card holder being positioned adjacent to the wrist portion.

3. The fitness support and storage accessory as claimed in claim 1 comprising:

each of the plurality of storage compartments comprising a compartment closure and lateral edge; and the compartment closure being positioned along the lateral edge.

4. The fitness support and storage accessory as claimed in claim 1 comprising:

the sleeve connector and the glove connector being a set of interlocking teeth.

5. The fitness support and storage accessory as claimed in claim 1 comprising:

the sleeve connector and the glove connector being magnets with opposing magnetic fields.

6. The fitness support and storage accessory as claimed in claim 1 comprising:

the sleeve connector and the glove connector being opposing hook and loop fasteners.

7. The fitness support and storage accessory as claimed in claim 1 comprising:

the sleeve comprising at least one breathable opening; and the at least one breathable opening traversing through the forearm cuff.

8. The fitness support and storage accessory as claimed in claim 1 comprising:

the forearm cuff comprising an accessibility zipper; and the accessibility zipper being positioned along the forearm cuff.

9. The fitness support and storage accessory as claimed in claim 1 comprising:

the hand portion comprising a palm section and a plurality of open finger sections; and the palm section being positioned in between the wrist section and the plurality of open finger sections.

10. The fitness support and storage accessory as claimed in claim 9 comprising:

the hand portion comprising a plurality of knuckle pads;

the plurality of knuckle pads being adjacently connected to the plurality of open finger sections; and the plurality of knuckle pads being positioned along the plurality of open finger section opposite the palm section.

11. The fitness support and storage accessory as claimed in claim 9 comprising:

the hand portion comprising a palm pad; and the palm pad being adjacently connected to the palm section.

12. The fitness support and storage accessory as claimed in claim 9 comprising:

the hand portion comprising an at least one pull tab; and the at least one pull tab being adjacently connected to the plurality of open finger sections.

13. The fitness support and storage accessory as claimed in claim 9, wherein each of the plurality of open finger sections terminates at a half finger length.

14. The fitness support and storage accessory as claimed in claim 1 comprising:

the hand portion being a boxing glove.

15. The fitness support and storage accessory as claimed in claim 1 comprising:

the proximal strap comprising a hook fastener and a loop fastener; and the hook fastener engaging the loop fastener.

16. The fitness support and storage accessory as claimed in claim 1 comprising:

the distal strap comprising a hook fastener and a loop fastener; and the hook fastener engaging the loop fastener.

* * * * *